US005695128A

United States Patent [19]

Oswald

[11] Patent Number: 5,695,128

[45] Date of Patent: Dec. 9, 1997

[54] REGULATING FAN SPRINKLER NOZZLE

[76] Inventor: Kenneth Wilson Oswald, 38 Canterbury Garden SW, Calgary, Alberta, Canada, T2W 2S9

[21] Appl. No.: 528,047

[22] Filed: Sep. 14, 1995

[51] Int. Cl.[6] ..... B05B 1/30

[52] U.S. Cl. ..... 239/546; 239/597

[58] Field of Search ..... 239/546, 552, 239/562, 568, 581.1, 597, 598

[56] References Cited

U.S. PATENT DOCUMENTS

| | | | |
|---|---|---|---|
| 424,422 | 3/1890 | Kuehn | 239/562 |
| 1,159,549 | 11/1915 | Thomas | 239/546 |
| 1,783,237 | 12/1930 | Greer | 239/568 |
| 1,865,012 | 6/1932 | Jackson | 239/546 X |
| 3,473,738 | 10/1969 | Mattos | 239/546 X |
| 3,511,468 | 5/1970 | Young | 239/568 X |
| 5,148,982 | 9/1992 | Ekhoff | 239/546 X |

*Primary Examiner*—Lesley D. Morris

[57] ABSTRACT

A simple and rugged sprinkler nozzle for use on an end portion of a length of tubing is disclosed. The sprinkler nozzle comprises a housing having: a tube end portion having a tube opening therein adapted to receive and be seated on the end portion of the length of tubing, the tube end portion additionally having a threaded cylindrical hole therein extending from outside the nozzle into the tube opening; a spray end portion having a lateral cut partially therethrough; a central portion having an internal path to conduct water fed from the tube in the tube end portion of the housing up to the lateral cut in the spray end portion of the housing; and, a set screw turned into the threaded cylindrical hole until tight against, and pinching the end portion of the tube thereby restricting flow therethrough and securing the sprinkler nozzle on the end portion of the tube. In the preferred embodiment a wear plug is inserted between the screw and the tube to protect the tube. The use of the set screw minimizes the probability of children making adjustments to the water flow. The sprinkler nozzle is ideal for use in planters, gardens along sidewalks, or any other location where a restricted and specific flow of water or chemical solution is desired.

10 Claims, 1 Drawing Sheet

REGULATING FAN SPRINKLER NOZZLE

BACKGROUND OF THE INVENTION

This invention relates to sprinkler nozzles. More particularly, this invention relates to stationary sprinkler nozzles of the type which regulate the flow of water or chemical solutions.

U.S. Pat. No. 3,301,493 issued to W. W. Frempter is for a discharge nozzle. His design comprises an upright hollow cylinder having a top end portion which is closed and a bottom inlet opening which is open and screwed into a water supply line. Supply water feeds in from the bottom and discharges radially and outwardly through a lateral opening in the wall of the cylinder. The problem with this arrangement is that there is no means to regulate the water flow.

OBJECTS AND STATEMENT OF THE INVENTION

It is an object of this invention to disclose a sprinkler nozzle which is rugged and simply constructed. It is an object of the invention to disclose a design for a sprinkler nozzle which regulates water flow therethrough so that the diameter of the semi-circular pattern of water spray may be adjusted to varying pressure and required areas of coverage. It is yet a further object of this invention to provide a design for sprinkler nozzle that is relatively tamper proof to adjustments by children. It is a final object of this invention to provide a sprinkler nozzle which is adapted for use along sidewalks or in planters where a restricted flow of water is required.

One aspect of this invention provides for a sprinkler nozzle for use on an end portion of a length of tubing comprising a housing having: a tube end portion having a tube opening therein adapted to receive and be seated on the end portion of the length of tubing, said tube end portion additionally having a threaded cylindrical hole therein extending from outside the sprinkler nozzle into the tube opening; a spray end portion having a lateral cut partially therethrough; a central portion having an internal path to conduct water fed from the tube in the tube end portion of the housing up to the lateral cut in the spray end portion of the housing; a screw turned into the threaded cylindrical hole until tight against, and pinching the end portion of the tube thereby restricting flow therethrough; and, means to secure the sprinkler nozzle on the end portion of the upright tube.

A preferred aspect of this invention provides for a sprinkler nozzle as above further comprising a wear plug inserted in the threaded cylindrical hole in the tube end of the housing to protect the tube, and wherein the means to secure the sprinkler nozzle on the end portion comprises a set screw which is the screw used to restrict flow. In the preferred embodiment the sprinkler nozzle is fabricated by cutting and drilling a block of aluminum.

Various other objects, advantages and features of this invention will become apparent to those skilled in the art from the following description in conjunction with the accompanying drawings.

FIGURES OF THE INVENTION

Figure 1:
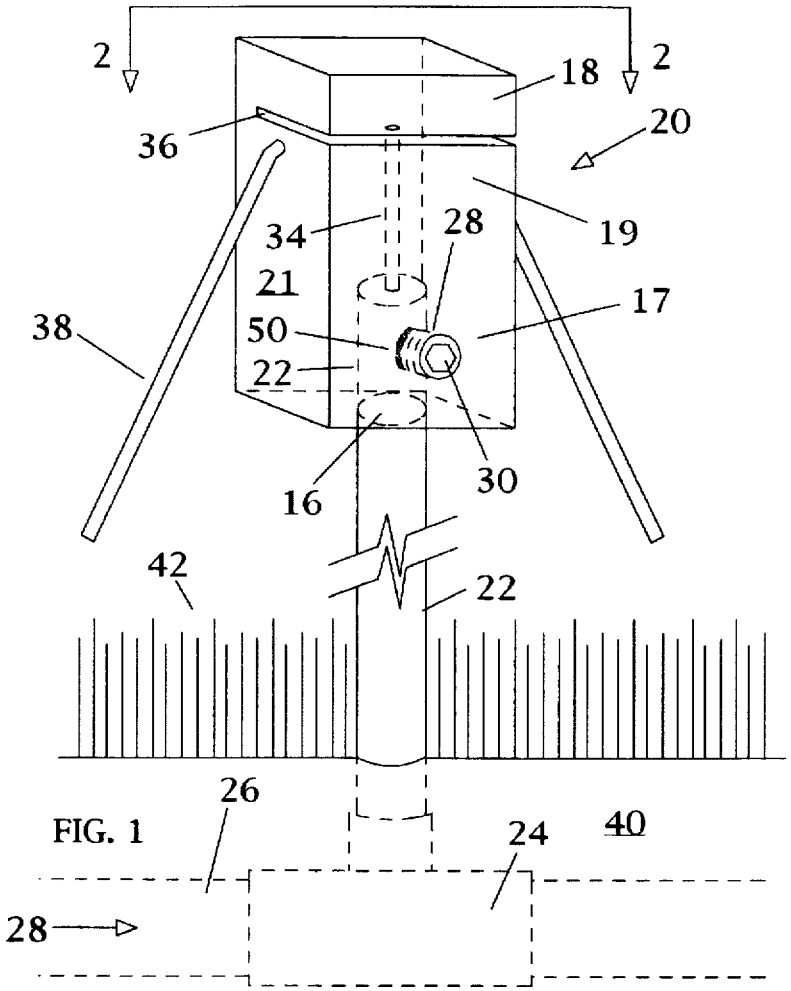
FIG. 1 is a perspective view of a sprinkler nozzle mounted on a water supply.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view of a regulating fan sprinkler nozzle 20. The nozzle 20 is seated on a length of tubing 22. The length of tubing 22 usually extends upwardly from a tee 24 (or other type of connector) in a main supply tubing 26. The main supply tubing 26 extends generally horizontally from a water supply 28. The main supply tubing 26 could be either nondetachably connected to the water supply 28 through a solenoid valve (not shown) or alternatively, simply screwed to one end of a garden hose (not shown) having the other end connected to a water outlet valve (not shown).

The sprinkler nozzle 20 comprises a housing 21 having a tube end portion 17, a spray end portion 18 and a central portion 19. The tube end portion 17 has a tube opening 16 therein which is adapted to receive and be seated on an end portion of the length of tubing 22, said tube end portion 17 additionally having a threaded cylindrical hole 28 therein extending from outside into the tube opening 16. The spray end portion 18 has a lateral cut 36 partially therethrough and the central portion 19 has an internal path 34 to conduct water fed from the tube 22 in the tube end portion of the housing 21 up to the lateral cut 36 in the spray end portion 18 of the housing 21.

Figure 2:
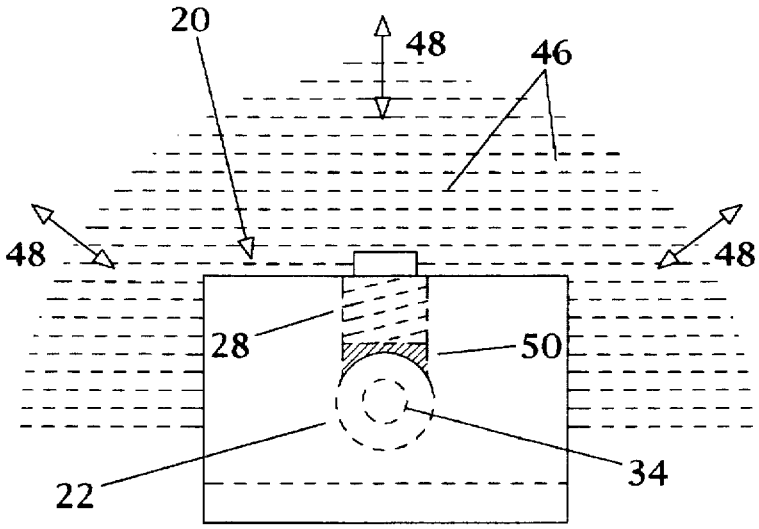
FIG. 2 is a plan view taken along lines 2—2 in FIG. 1 showing the spray coverage area of the sprinkler nozzle.

FIG. 2 shows a typical water coverage area 46 from a single sprinkler nozzle 20. The water coverage area 46 is typically semi circular when the sprinkler nozzle 20 is positioned on the end portion of the tube 22 when it is upright. The radius 48 of the water coverage area 46 can be varied by adjusting the screw which may be a thumb screw, bolt or most preferably a set screw 30. In addition to controlling the rate of water flow through the sprinkler nozzle 20, the set screw 30 ensures that the length of tubing 22 is retained in the sprinkler nozzle 20. The use of a set screw 30 minimizes the probability of children making adjustments.

In the preferred embodiment the regulating fan sprinkler nozzle 20 is fabricated by cutting and drilling an aluminum block housing 21 generally 1 inch high and ½ inch wide×⅝ inch deep. The tube end portion of the block 21 has a longitudinally aligned ¼ inch diameter hole drilled therein so that the sprinkler nozzle 20 can be slid over an end portion of a ¼ inch diameter tube 22. The set screw 30 is screwed laterally into a threaded hole 28 into the aluminum block 21 up against a wear plug 50 thereby causing it to pinch the end portion of the length of tubing 22 and restrict the water flow therethrough. The wear plug 50 is inserted between the tube 22 and the screw 30 in the threaded cylindrical hole 28 in the tube end portion 17 of the housing 21 to reduce any damage to the tube 22 which might be caused by the screw 30 being in direct contact with the tube 22. Water passing upwardly through the pinched length of tubing 22 then passes through a drilled internal path 34 to a lateral cut 36 in the top portion of the aluminum block 21. It has been found that a lateral cut 36 less than 1/16 inch in thickness works well.

It has also been found that a rigid wire 38 passing laterally through the aluminum block 21 and extending downwardly on either side of the block is useful in handling and installing the regulating fan sprinkler nozzle 20. The use of the rigid wire 38 is optional.

In FIG. 1, the main supply tubing 26 is shown buried in the ground 40 beneath the grass 42 or other vegetation. The regulating fan sprinkler nozzle 20 is ideally suited for use in planters, gardens, along sidewalks (all not shown) or any other location where a specific and restricted spray of chemical solution or water 28 is desired. The main supply tubing 26 would typically feed multiple nozzles 20 along its length. Usually the sprinkler nozzle is used in an upright position; however, the nozzle may be used on any angle desired, and for some applications such as a flower box, a vertical spray may be desired.

While the invention has been described with preferred specific embodiments thereof, it will be understood that this description is intended to illustrate and not to limit the scope of the invention, which is defined by the following claims.

I claim:

1. A sprinkler nozzle for use on an end portion of a length of tubing comprising a housing having:

a tube end portion having a tube opening therein adapted to receive and be seated on an end portion of a length of tubing, said tube end portion additionally having a threaded cylindrical hole therein extending from outside into the tube opening;

a spray end portion having a lateral cut partially therethrough;

a central portion having an internal path to conduct water fed from the length of tubing in the tube end portion of the housing up to the lateral cut in the spray end portion of the housing;

a screw turned into the threaded cylindrical hole until tight against, and pinching the end portion of the length of tubing thereby restricting flow therethrough; and, means to secure the sprinkler nozzle on the end portion of the length of tubing.

2. A sprinkler nozzle for use on an end portion of a length of tubing comprising a housing having:

a tube end portion having a tube opening therein adapted to receive and be seated on an end portion of a length of tubing, said tube end portion additionally having a threaded cylindrical hole therein extending from outside into the tube opening;

a spray end portion having a lateral cut partially therethrough;

a central portion having an internal path to conduct water fed from the length of tubing in the tube end portion of the housing up to the lateral cut in the spray end portion of the housing;

a wear plug inserted in the threaded cylindrical hole in the tube end portion of the housing;

a screw turned into the threaded cylindrical hole until tight against the wear plug, thereby causing the wear plug to pinch the end portion of the length of tubing and thereby restrict flow therethrough; and, means to secure the sprinkler nozzle on the end portion of the length of tubing.

3. A sprinkler nozzle as in claim 2 wherein the means to secure the sprinkler nozzle on the tube end portion of the housing comprises the screw used to restrict flow.

4. A sprinkler nozzle as in claim 3 wherein the screw is a set screw.

5. A sprinkler nozzle as in claim 3 wherein the screw is a thumb screw.

6. A sprinkler nozzle as in claim 3 wherein the screw is a bolt.

7. A sprinkler nozzle as in claim 3 wherein the sprinkler nozzle is metal.

8. A sprinkler nozzle as in claim 7 wherein the sprinkler nozzle is formed by cutting and drilling a block of metal.

9. A sprinkler as in claim 8 wherein the block of metal is aluminum.

10. A sprinkler as in claim 9 wherein the sprinkler nozzle further comprises a rigid wire passing laterally through the aluminum block which extends downwardly on either side of the block, said rigid wire facilitating handling and installation of the sprinkler nozzle.

* * * * *